US011466332B2

(12) United States Patent
Cameron

(10) Patent No.: US 11,466,332 B2
(45) Date of Patent: Oct. 11, 2022

(54) PROCESS FOR INJECTING PARTICULATE MATERIAL INTO A LIQUID METAL BATH

(71) Applicant: Linde GmbH, Pullach (DE)

(72) Inventor: Andrew Cameron, Chester (GB)

(73) Assignee: Linde GmbH, Munich (DE)

( * ) Notice: Subject to any disclaimer, the term of this patent is extended or adjusted under 35 U.S.C. 154(b) by 192 days.

(21) Appl. No.: 16/770,109

(22) PCT Filed: Dec. 6, 2018

(86) PCT No.: PCT/EP2018/025310
§ 371 (c)(1),
(2) Date: Jun. 5, 2020

(87) PCT Pub. No.: WO2019/110147
PCT Pub. Date: Jun. 13, 2019

(65) Prior Publication Data

US 2020/0385829 A1 Dec. 10, 2020

(30) Foreign Application Priority Data

Dec. 6, 2017 (EP) ..... 17020559

(51) Int. Cl.
*C21C 7/00* (2006.01)
*C21C 5/32* (2006.01)
(Continued)

(52) U.S. Cl.
CPC ..... *C21C 7/0037* (2013.01); *C21C 5/32* (2013.01); *C21C 5/4606* (2013.01); *C21C 7/068* (2013.01)

(58) Field of Classification Search
CPC ..... C21C 5/32; C21C 5/4606; C21C 7/0037; C21C 7/068; F27B 3/225; F27D 3/18
(Continued)

(56) References Cited

U.S. PATENT DOCUMENTS 4,426,224 A 1/1984 Shimme et al.
4,434,005 A * 2/1984 Metz ..... C21C 5/4606 266/225
(Continued)

FOREIGN PATENT DOCUMENTS

CN 1324411 C 7/2007
CN 105 316 452 A 2/2016
(Continued)

OTHER PUBLICATIONS

International Search Report of the International Searching Authority for PCT/EP2018/025310 dated Jan. 18, 2019.
(Continued)

*Primary Examiner* — Jessee R Roe
*Assistant Examiner* — Michael Aboagye
(74) *Attorney, Agent, or Firm* — Millen White Zelano & Branigan, PC; Brion P. Heaney

(57) ABSTRACT

The invention relates to a process for injecting particulate material into a liquid metal bath wherein the liquid metal bath contains species to be oxidized, wherein the particulate material is carried to the liquid bath by means of a first gas stream. The solids injection rate is controlled such that the liquid bath temperature and/or the evolution of the liquid bath temperature is maintained within a pre-defined temperature range and the penetration depth of the first gas stream into the liquid bath is controlled by adjusting the flow of the first gas stream. At least one second gas stream is injected into the liquid, wherein the first and the second gas streams are an oxidizing gas, in particular oxygen, and the sum of the gas flows of the first and the second gas streams is determined based on the mass of the species to be oxidized and on the desired time for oxidizing the mass of the species.

25 Claims, 1 Drawing Sheet

Figure 1:
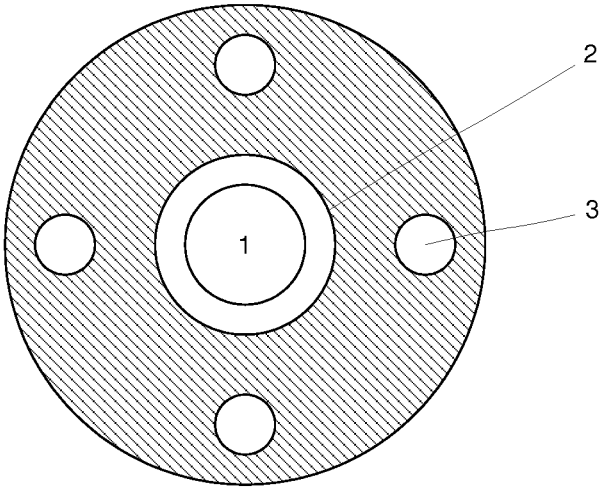

(51) Int. Cl.
*C21C 5/46* (2006.01)
*C21C 7/068* (2006.01)

(58) Field of Classification Search
USPC ..... 266/216, 225, 218, 224, 217, 268; 75/533, 528
See application file for complete search history.

(56) References Cited

U.S. PATENT DOCUMENTS

| | | | | |
|---|---|---|---|---|
| 6,244,854 | B1 * | 6/2001 | Satchell, Jr. ..... | F23C 3/00 431/185 |
| 6,558,614 | B1 | 5/2003 | Fritz | |
| 7,396,503 | B2 * | 7/2008 | Cameron ..... | C21C 5/5217 266/225 |
| 8,142,543 | B2 * | 3/2012 | Cameron ..... | C21C 5/005 75/533 |
| 2006/0060028 | A1 | 3/2006 | Cameron et al. | |
| 2009/0173187 | A1 * | 7/2009 | Cameron ..... | C21C 5/5264 75/10.42 |

FOREIGN PATENT DOCUMENTS

| | | |
|---|---|---|
| EP | 1 511 871 A1 | 3/2005 |
| EP | 1 511 871 B1 | 3/2006 |

OTHER PUBLICATIONS

Office Action in corresponding Chinese application 201880078317.3 dated May 4, 2022 (pp. 1-11).

* cited by examiner

PROCESS FOR INJECTING PARTICULATE MATERIAL INTO A LIQUID METAL BATH

The invention relates to a process for injecting particulate material into a liquid metal bath by means of a lance, the lance comprising an axial solids injection pipe, wherein the liquid metal bath contains species to be oxidized, wherein the particulate material is carried to the liquid bath by means of a first gas stream and wherein the first gas stream with the particulate material penetrates into the liquid bath.

In stainless steel making the molten metal is subjected to an oxygen refining step which typically comprises decarburization and de-siliconization. The oxygen flow required for this refining step can be estimated with reference to the mass of carbon and silicon to be removed and an assumption of constant oxygen consumption for the duration of the refining step.

The oxidative refining reactions of carbon and silicon will generate heat and the temperature of the liquid metal bath could increase. From a metallurgical perspective it is desirable to minimise the metal bath temperature increase or to maintain the temperature within a certain range. Thus, it is known to add scrap to the metal bath in order to moderate the temperature.

On the other hand, large quantities of dusts and particulates are generated during steel-making. They are unwelcome by-products of the production of stainless steel and ferro-alloys. These materials represent a loss of yield and since they are often classified as hazardous wastes, substantial costs can be associated with their disposal, storage or re-processing.

If the materials could be recycled to the steelmaking converter these costs could be avoided and environmental impact could be reduced.

WO 03/091460 A1 discloses a metallurgical lance for injecting particulate material into a liquid metal bath. The lance comprises a main gas tube defining an axial main gas passage terminating in a first Laval nozzle. Carrier gas containing particulate material is passed into the accelerating main gas jet and the particulate material is thus carried out of the Laval nozzle at supersonic velocity. The main gas jet is shrouded by an annular supersonic flow of burning hydrocarbon gas.

The lance described in WO 03/091460 A1 has been designed to increase the penetration depth of the particulate material into the liquid metal. However, if the penetration becomes too much there is a risk of damage to the refractories in the base or bottom of the furnace or converter. The addition of solids to the central main gas jet makes the jet even more penetrative.

Further, injection of particulates to a converter changes the physics and chemistry of the process. In terms of the physics it is important that the stream of particulates penetrates the liquid bath to sufficient depth to ensure a good recovery of the injected materials. It is also important to ensure that the liquid metal cavitation is not so severe that it results in erosion of the bottom of the converter or excessive splash due to break up of the liquid surface at the jet impingement zone.

In terms of the process chemistry, injection of cold particulates into a converter will change the heat and mass balance and the injection rate should be selected to ensure that the temperature of the liquid be controlled within acceptable limits.

It is an object of the present invention to provide a process for injecting particulate material into a liquid metal bath which ensures that the above mentioned physical and chemical requirements are met.

It is in particular an object to propose a process for injecting particulate material into a liquid metal bath which allows to penetrate the particulate material deep enough into the liquid metal bath to ensure a good recovery of the injected material but which avoids too deep penetration which could damage the bottom of the converter or excessive splashing of the liquid content.

These risks of damage could, in principle, be overcome by reducing the injection rate but this would limit the metallurgical or cost benefits. It is also possible to reduce the oxygen flow rate but this would increase the oxygen blow times and reduce the productivity. Further, one could increase the lance height, i.e. the distance between the lance outlet and the surface of the metal bath. But if the height becomes significantly more than the potential core length of the supersonic main gas jet, the oxygen efficiency will be reduced due to entrainment and divergence.

These objects are at least partly solved by a process for injecting particulate material into a liquid metal bath by means of a lance, the lance comprising an axial solids injection pipe, wherein the liquid metal bath contains species to be oxidized, wherein the particulate material is carried to the liquid bath by means of a first gas stream and wherein the first gas stream with the particulate material penetrates into the liquid bath, and which is characterized in that the solids injection rate is controlled such that the liquid bath temperature is maintained within a first pre-defined temperature range and/or the evolution of the liquid bath temperature is maintained within a second pre-defined range, wherein the solids injection rate is defined as the mass of particulate material introduced into the liquid bath per time unit, in that the penetration depth of the first gas stream into the liquid bath is controlled by adjusting the flow of the first gas stream, in that at least two second gas streams are injected into the liquid at a diverging angle from the first gas stream, in that the first and the second gas streams are an oxidizing gas, in particular oxygen, and in that the sum of the gas flows of the second gas streams is controlled such that the liquid bath temperature is maintained within the first pre-defined temperature range and/or the evolution of the liquid bath temperature is maintained within the second pre-defined range.

The invention relates to the injection of particulate material into a liquid metal bath. The liquid metal bath is preferably a melt of a ferroalloy which contains for example at least 10% per weight iron or at least 25% per weight iron. The invention is preferably used in the field of stainless steel and ferroalloy production and processing. But the invention could also be used to inject particulate material in non-ferrous base metal baths such as copper, Pb, Zn or Sn.

The term "particulate material" shall preferably mean solid particles, in particular small solid particles with a mean particle size of less than 20 mm, less than 10 mm, less than 3 mm or less than 1 mm.

The liquid metal bath contains species which shall be oxidized. Such species are, for example, carbon and/or silicon and/or carbon or silicon containing compounds. Another advantageous feature of the inventive process can be that when the particulate material contains oxides of valuable species such as Cr or Ni or Mo these species are reduced by reaction with the oxidisable species and are recovered as metals. In that respect, a degree of direct smelting is incorporated into what was previously purely an oxidative refining process.

In order to oxidize these species an oxidizing gas is introduced into the liquid metal bath. In the metal bath the oxidizing gas reacts with the species in an exothermic reaction which without any corrective action causes a temperature increase of the metal bath. From a metallurgical perspective it is desirable to control the solid injection rate so as to maintain a constant or essentially constant bath temperature or to control the temperature evolution associated with the refining reactions. Thus, the invention proposes to inject particulate material into the metal bath. The introduction of the particulate material has a coolant effect that helps to limit or control the metal bath temperature and/or the increase of the metal bath temperature.

However, if too much particulate is injected into the liquid metal bath there is a risk of too deep penetration into the bath which might damage the refractories in the base or bottom of the furnace or converter. Thus, the invention proposes to adjust the flow of the first gas stream in such a way that the particulate jet stream, that is the first gas flow together with the particulate material to be injected, does not penetrate too deep into the liquid metal bath. By reducing the gas flow the momentum of the particulate jet stream and thus the penetration depth is reduced.

The solids injection rate and the total flow of first and second gas streams are interdependent. For example, oxides injected into the metal bath can react with species in the metal bath in an endothermic reaction. In that case the injected solid material acts as a heat sink reducing the temperature of the metal bath. On the other hand, when ferrosilicon particulates are injected into the bath, they will exothermically react with the first and second gas streams to oxides and thereby increase the temperature of the metal bath.

Therefore, the invention further proposes to inject second oxidizing gas streams into the bath such that the temperature of the bath is maintained within a first pre-defined temperature range and/or that the evolution, i.e. increase or decrease, of the liquid bath temperature is maintained within a pre-defined second range.

According to the invention the second gas streams are injected into the bath at a diverging angle relative to the first gas stream and preferably divergent relative to each other. Thus, the first gas stream and the second gas streams will enter the liquid metal bath at different points, distant to each other. Therefore, the second gas streams do not contribute to the penetration of the particulate material into the liquid bath. Further, since the total momentum is distributed to a multiplicity of first and second gas streams, it is more uniformly distributed over the surface of the liquid metal bath and the risk of splashing is considerably reduced.

The invention introduces an additional degree of freedom for controlling the process. By distributing the oxidizing gas to several nozzles the flow of the first gas stream will only have a certain percentage of the total gas flow. Since the gas flow is a fundamental variable determining cavitation, penetration depth and splashing these effects will be considerably reduced by the inventive method. Thus, compared to an injection lance with only one common impingement point for all gas streams, it will be possible to inject more solids before the penetration becomes excessive.

The temperature of the liquid metal bath is related to the chemical reactions taking place in the liquid metal bath. The heat release associated with oxidative refining reactions can be calculated using a thermodynamic process model or it can be estimated from the knowledge of the input and output metal compositions, the blowing time and the heats of reaction for the relevant refining reactions (e.g. $C+\frac{1}{2}O_2 \rightarrow CO$ and $Si+O_2 \rightarrow SiO_2$).

Once the heat release (MJ/min) is known it is possible to define an injection rate to balance this with a matched thermal load. This is essentially the sum of the heat required to heat the material to the process temperature plus the heat of any reactions that may occur (e.g. reduction of oxides to the metallic state as well as heat required for any change of state such as melting) during the blowing time.

The net heat input will be the difference between the sum of the exothermic reaction heats and the sum of the endothermic heat requirements. This heat balance will define the net energy input available to heat (or cool) the converter contents. Consequently the solids injection rate required to result in a desired final product temperature can be calculated.

According to the invention the solids injection rate is controlled in such a way that the temperature of the metal bath is maintained within a pre-defined temperature range. For example, the temperature of the liquid metal bath shall be kept within a first pre-defined temperature range from 1000° C. to 2000° C., preferably from 1450° C. to 1850° C., preferably from 1500° C. to 1650° C. for the time period when the species in the metal bath is oxidized (blowing time).

According to another embodiment of the invention, the solids injection rate is controlled in such a way that the evolution of the liquid bath temperature is maintained within a pre-defined temperature. That means the temperature increase or decrease per time unit shall be maintained with a certain range. For example, the temperature increase per minute shall be less than 20° C./min or less than 15° C./min or less than 10° C./min.

In another embodiment the solids injection rate is controlled such that both requirements are fulfilled, namely that the liquid bath temperature is maintained in a certain range and the evolution of the liquid bath temperature is also maintained within certain limits.

The particulate material is introduced into the liquid bath by means of the first gas stream. Penetration of coaxial jets of gas and solids into liquids has been studied by Sohn and co-workers (Sohn et al., Metallurgical and Material Transactions B, Vol 41 B, February 2010, pp 51-62). They have developed empirical expressions to calculate the depth of cavitation. The key equation defines a relationship between lance height, penetration depth, momentum of the gas and solid jet and a lance constant.

Too deep penetration of the gas and solid jet into the liquid bath could cause excessive splashing and a risk of damage to the bottom of the vessel. Thus, the invention proposes to control the penetration depth of the first gas stream into the liquid bath by adjusting the flow of the first gas stream. The term "flow of the gas stream" shall mean the mass of gas per time unit. The solids loading of the central jet is, for example, controlled by adjusting the gas flow for a given particle injection rate (as defined by the heat balance).

The total required flow of oxidizing gas depends on the type of the species to be oxidized, on its mass and on the desired time for oxidizing the mass of the species.

According to the invention the required oxidizing gas is supplied by means of the first gas stream and two or more second gas streams. The flow of the first gas stream is determined based on the desired penetration depth and the flow of the second gas streams is determined such that the total flow of oxidizing gas is sufficient to oxidize the species and that the temperature of the metal bath is maintained within a pre-defined range and/or the evolution of the temperature is maintained within a pre-defined range. The total gas flow required for oxidizing the species is split into the first gas stream and the second gas streams.

According to a preferred embodiment, the invention is used in a process wherein the lance is provided vertical to the surface of the liquid bath. In particular, the solids injection pipe is vertical and the particulate material is introduced perpendicular to the liquid bath. In this case there is a considerable risk of too deep penetration and related damage to the bottom of the vessel with the liquid bath and the invention is in particular advantageous.

The lance is provided at a lance height above the liquid bath wherein the lance height being defined as the distance in axial direction between the outlet of the solids injection pipe and the surface of the liquid bath. Preferred lance heights are in the range 0.75 m to 2.5 m, for example 1.00 m, 1.50 m, 1.75 m or 2.00 m. According to one embodiment, the penetration depth of the first gas stream is also controlled by adjusting the lance height and/or the velocity of the first gas stream.

According to another embodiment the flow and/or the velocity of the first gas stream and the flow and/or the velocity of the second gas streams can be adjusted independently. This allows to optimize the penetration depth as well as the refining/oxidation of the species.

In case the total flow of first and second gas streams is maintained constant it is also possible to adjust the first and second gas stream synergistically in order to optimize the penetration of the first gas stream into the liquid bath.

According to another embodiment of the invention the first gas stream is provided at a velocity between 340 m/s and 1100 m/s, preferably between 500 m/s and 900 m/s. It has been found that this velocity range ensures that the particulate material penetrates deep enough into the liquid bath to be captured by the liquid without causing excessive cavitation and splashing.

According to another embodiment of the invention the second gas streams are provided at a velocity between 340 m/s and 1100 m/s, preferably between 500 m/s and 900 m/s. The second gas streams do not need to have the same mass flow as the first gas stream as they do not carry any particulate material into the liquid bath. The velocity of the second gas streams is preferably determined such that the injected oxidizing gas gets into close contact with the species to be oxidized in order to ensure good oxygen efficiency.

According to another embodiment of the invention the penetration depth is less than 75% of the depth of the liquid bath, preferably less than 50% of the depth of the liquid bath, more preferred less than 25% of the depth of the liquid bath. It has been found that these ranges of penetration depths are a good compromise between the conflicting requirements of deep penetration so that the particulate material is captured by the liquid and a low penetration to avoid damage or erosion of the bottom of the vessel accommodating the liquid bath.

According to another embodiment of the invention the first gas stream and/or the second gas streams comprise at least 80% by volume oxygen, preferred at least 90% by volume oxygen, more preferred technical pure oxygen. These oxygen concentrations allow to reduce the total blowing time for oxidizing the species to a minimum.

According to another embodiment of the invention more than 20 kg/min particulate material, preferably more than 50 kg/min particulate material, is injected into the liquid bath.

According to another embodiment of the invention the particulate material contains a metallurgical reagent. The term "metallurgical reagent" shall mean a chemical ingredient, a compound or a mixture, which is introduced into the liquid bath to cause a desired reaction with the liquid metal or substances present in the liquid metal bath. Such metallurgical reagents could be iron, chromium, molybdenum, nickel, manganese and/or alloys of these metals. Other metallurgical reagents could be lime or dolime (CaO or CaO.MgO). Typical waste material which is recycled by injecting as particulate material into the liquid bath could be scales, slags, dusts, powders, or granules. The waste material could be condensed fumes from process off-gases (e.g. EAF dusts), scales from rolling mills, undersized materials from granulation operations or crushed oxides.

According to another embodiment of the invention the particulate material is injected into a metallurgical converter, such as a BOS (Basic Oxygen Steel-Making) converter, an AOD (Argon-Oxygen-Decarburization) converter or a CLU (superheated steam) converter.

The main purpose of the second gas streams is to supply sufficient oxidizing gas to oxidize the species. Further, the second gas streams shall not increase the core length of the first gas stream so that the combined stream of first gas and particulate material becomes more penetrative. Thus, the second gas streams do not interact with the first gas stream, for example, the second gas streams shall not be entrained into the first gas stream. Therefore, the second gas streams are divergent from the first gas stream. The angle of divergence between the first gas stream and each of the second gas streams is preferably between 5 and 20°. According to a preferred embodiment the second gas streams also diverge from each other and the angle of divergence between each pair of second gas streams is preferably between 5° and 20°.

According to another embodiment of the invention there are provided between 2 and 8 second gas streams, preferably between 3 and 6 second gas streams, preferably 3 or 4 second gas streams. Preferably, the second gas streams are evenly distributed on a circle around the central first gas stream. For example, the nozzles of a lance with three second gas streams are arranged at angles of 120° between each other, the nozzles of a lance with four second gas streams are arranged at angles of 90° relative to each other.

According to another embodiment of the invention the species to be oxidized is carbon and/or silicon. The species could also be manganese, phosphorous, or sulphur According to another preferred embodiment, the invention is employed in a metallurgical refining process, in particular in the manufacture of stainless steel and/or other ferroalloys or base metals such as copper, lead, zinc or tin.

The invention as well as further embodiments and details of the invention shall be described with reference to the attached drawings. Therein, FIG. 1 shows the top view on a lance head for use with the present invention, FIG. 2 shows the cross section of the lance according to FIG. 1.

FIG. 1 shows a multi-port injection lance with a central solids injection pipe 1 surrounded by an annular channel 2 for the first gas stream. The lance head further comprises four nozzles 3 for second gas streams. The four outer nozzles 3 are evenly distributed on a circle around the central solids injection pipe 1.

Figure 2:
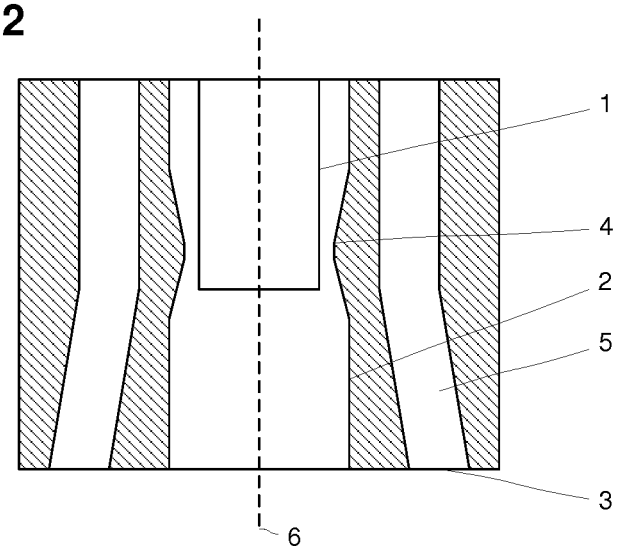

As shown in FIG. 2 the annular channel 2 is provided with a Laval nozzle 4 for accelerating the first gas stream. The solids injection pipe 1 terminates downstream of the throat of the Laval nozzle 4.

Four outer channels 5 terminating in the outer nozzles 3 are arranged around the central solids injection pipe 1 and the annular channel 2. The outer channels 5 are divergent with respect to the central solids injection pipe 1 and the axis 6 of the lance. The angle between the solids injection pipe 1 and an outer channel 5 is between 5° and 20°, preferably between 7 and 15°.

The multi-port lance according to FIGS. 1 and 2 is used for injecting particulate material, such as dusts, scales, granules or powders into a converter for manufacturing stainless steel. The lance is arranged with its axis in a vertical direction. The particulate material is supplied via the central solids injection pipe 1. Technical pure oxygen with a purity of more than 99.3% by volume is supplied to the annular channel 2. In Laval nozzle 4 the oxygen stream is accelerated to a supersonic velocity, for example to Mach 2. The particulate material leaving the central solids injection pipe 1 is entrained into the surrounding supersonic oxygen stream and accelerated. The resulting stream of oxygen and particulate material is perpendicular to the surface of the liquid metal in the converter.

Technical pure oxygen is also supplied to the outer channels 5. The oxygen streams (second gas streams) leave the outer nozzles 3 divergent to the central first stream of oxygen and particulate material. The second gas streams do not form a continuous coaxial gas envelope with the central first gas stream. Instead there will be four distinct second gas streams and four distinct impact zones for the outer oxygen streams on the surface of the liquid metal bath.

The total oxygen mass required depends on the mass of species which shall be oxidised. For sake of simplicity it is assumed that the oxygen is uniformly consumed during the blowing time. The total oxygen flow can then be calculated from the total oxygen mass and the duration of the oxygen blow (blowing time).

For example, the duration of the oxygen blow is pre-set to 20 minutes. Thus all species shall be oxidised within these 20 minutes. The total oxygen flow is distributed to the annular channel 2 and the outer channels 5. The proportion sent to the annular channel 2 is calculated depending on the desired lance height, the lance and nozzle type and the required penetration depth. The remaining oxygen is sent to the outer channels 5.

The invention claimed is:

1. A process for injecting particulate material into a liquid metal bath by means of a lance, wherein the liquid metal bath contains species to be oxidized and the lance comprises an axial solids injection pipe, said process comprising;

injecting the particulate material into the liquid bath by means of a first gas stream and wherein the first gas stream with the particulate material penetrates into the liquid metal bath, controlling solids injection rate of the particulate material such that the liquid metal bath temperature is maintained within a first pre-defined temperature range and/or evolution of the liquid metal bath temperature is maintained within a second pre-defined range, wherein the solids injection rate is defined as the mass of particulate material introduced into the liquid metal bath per time unit, controlling penetration depth of the first gas stream into the liquid metal bath by adjusting the flow of the first gas stream, injecting at least two second gas streams into the liquid metal bath at a diverging angle from the first gas stream, wherein the first gas stream and the second gas streams are in each case an oxidizing gas, and wherein gas flows of the second gas streams are controlled such that the liquid metal bath temperature is maintained within the first pre-defined temperature range and/or the evolution of the liquid metal bath temperature is maintained within the second pre-defined range.

2. The process according to claim 1, wherein the lance is provided at a lance height above the liquid metal bath, the lance height being defined as a distance in axial direction between an outlet of the axial solids injection pipe and the surface of the liquid metal bath, and that the penetration depth of the first gas stream is further controlled by adjusting the lance height and/or the flow of the first gas stream.

3. The process according to claim 1, wherein the first gas stream is provided at a velocity between 340 m/s and 1100 m/s.

4. The process according to claim 1, wherein the second gas streams are provided at a velocity between 340 m/s and 1100 m/s.

5. The process according to claim 1, wherein the penetration depth is less than 75% of the depth of the liquid metal bath.

6. The process according to claim 1, wherein the first gas stream and/or the second gas streams comprise at least 80% by volume oxygen.

7. The process according to claim 1, wherein more than 20 kg/min particulate material is injected into the liquid metal bath.

8. The process according to claim 1, wherein the particulate material contains a metallurgical reagent.

9. The process according to claim 1, wherein the particulate material is injected into a metallurgical converter.

10. The process according to claim 1, wherein the first pre-defined temperature range is from 1000° C. to 2000° C.

11. The process according to claim 1, wherein the evolution of the liquid metal bath temperature is less than +/−20° C./min.

12. The process according to claim 1, wherein the diverging angle between the first gas stream and one of the second gas streams is between 5° and 20°.

13. The process according to claim 1, wherein between 2 and 8 second gas streams are provided.

14. The process according to claim 1, wherein the species to be oxidized is carbon and/or silicon.

15. The process according to claim 1, wherein the lance is provided vertical to the surface of the liquid metal bath.

16. The process according to claim 1, wherein said process is employed in a metallurgical refining process.

17. The process according to claim 1, wherein the first and the second gas streams are at least 90% by volume oxygen.

18. The process according to claim 1, wherein the first gas stream is provided at a velocity between 500 m/s and 900 m/s, and the second gas streams are provided at a velocity between 500 m/s and 900 m/s.

19. The process according to claim 1, wherein the penetration depth is less than 50% of the depth of the liquid metal bath.

20. The process according to claim 1, wherein between 3 and 6 second gas streams are provided.

21. The process according to claim 1, wherein the first gas stream and the second gas streams enter the liquid metal bath at different points distanced from each other.

22. The process according to claim 1, wherein the second gas streams diverge from each other and the angle of divergence between each pair of second gas streams is between 5° and 20° .

23. The process according to claim 1, wherein the lance comprises an annular channel, around said axial solids injection pipe, for introduction of said first gas stream into the liquid metal bath, and a plurality of outer channels, each terminating in an outer nozzle, arranged around the annular channel and said axial solids injection pipe, for introduction of the second gas streams.

24. The process according to claim 1, wherein the diverging angle between the first gas stream and one of the second gas streams is between 7° and 15° .

25. The process according to claim 1, wherein the diverging angle between the first gas stream and each of the second gas streams is between 5° and 20° .

* * * * *